US005480061A

United States Patent [19]

Ellinger

[11] Patent Number: 5,480,061

[45] Date of Patent: Jan. 2, 1996

[54] PORTABLE TABLETOP COOKIE DISPENSER

[75] Inventor: Victor H. Ellinger, Mesa, Ariz.

[73] Assignee: E & S Dispenser Company, Tempe, Ariz.

[21] Appl. No.: 299,272

[22] Filed: Sep. 1, 1994

[51] Int. Cl.[6] ..... G07F 11/36

[52] U.S. Cl. ..... 221/75; 221/155; 221/200; 221/203; 221/287; 198/548; 222/413

[58] Field of Search ..... 221/75, 155, 200, 221/202, 203, 154, 281, 282, 286, 287, 45, 46; 198/550.1, 548; 414/326; 222/413

[56] References Cited

U.S. PATENT DOCUMENTS

| | | | |
|---|---|---|---|
| 924,407 | 6/1909 | Whitcomb | 221/155 |
| 1,712,479 | 5/1929 | Allen et al. | 221/154 X |
| 3,473,702 | 10/1969 | Molitor | 222/413 X |
| 3,719,307 | 3/1973 | Larson | 222/413 X |
| 4,938,382 | 7/1990 | Frazier et al. | 221/45 |
| 4,997,109 | 3/1991 | Carper | 222/413 X |
| 5,100,020 | 3/1992 | Petterson et al. | 221/45 |
| 5,215,211 | 6/1993 | Eberle | 221/46 X |
| 5,219,103 | 6/1993 | Carper | 198/550.1 X |

*Primary Examiner*—William E. Terrell
*Assistant Examiner*—Dean A. Reichard
*Attorney, Agent, or Firm*—Harry M. Weiss; Jeffrey D. Moy; Harry M. Weiss & Associates

[57] ABSTRACT

A portable tabletop or counter top cookie dispenser has a transparent container. A pair of laterally spaced partitions extends lengthwise of the container along the bottom of the latter, and the partitions define a trough which opens to a discharge chute at the front of the container. Inclined guide walls are mounted in the container above the trough and serve to funnel cookies placed in the container to the rear of the trough. A screw conveyor is located in and extends longitudinally of the trough. The screw conveyor is driven by a handwheel disposed at the front of the container externally thereof. When the handwheel is rotated, the screw conveyor urges cookies in the trough towards the discharge chute.

15 Claims, 1 Drawing Sheet

PORTABLE TABLETOP COOKIE DISPENSER

FIELD OF THE INVENTION

The invention relates to a dispenser for discrete commodities.

BACKGROUND OF THE INVENTION

When a consumer purchases loose cookies, the usual procedure is for the consumer to tell a clerk what type and quantity of cookies are desired. Although this is inconvenient in a busy store, placing of the cookies in an open container for self-service by consumers is undesirable for sanitary reasons. Furthermore, this would result in substantial waste due to breakage.

SUMMARY OF THE INVENTION

It is accordingly an object of the invention to provide a dispenser which allows discrete commodities, e.g., loose cookies, to be dispensed in a sanitary manner.

Another object of the invention is to provide a dispenser which enables breakage to be reduced.

An additional object of the invention is to provide a method which makes it possible to dispense discrete commodities sanitarily.

A further object of the invention is to provide a dispensing method which can be used to reduce breakage.

The preceding objects, as well as others which will become apparent as the description proceeds, are achieved by the invention.

One aspect of the invention resides in a dispenser for discrete commodities. The dispenser comprises, in combination, a container having an outlet and defining a storage chamber for the commodities, a screw conveyor in the chamber arranged to advance the commodities towards the outlet, and means for driving the screw conveyor.

Since the commodities are discharged from the container using a screw conveyor, it is not necessary for consumers to place their hands in the container so that the commodities can be dispensed in a sanitary fashion. Moreover, inasmuch as there is no need for consumers to put their hands into the container, the likelihood of breakage is reduced.

Another aspect of the invention resides in a method of dispensing a commodity from a container. The method comprises the steps of admitting the commodity into a predetermined path, advancing the commodity along the path by repeatedly subjecting the commodity to forces having a first component longitudinally of the path and a second component radially of the path, and discharging the commodity from the container at a predetermined location of the path.

The path may have a section upstream of and remote from the location at which the commodity is discharged from the container and the commodity is preferably fed to this section for introduction into the path. The step of discharging the commodity from the container can be carried out using gravity.

BRIEF DESCRIPTION OF THE DRAWINGS

Additional features and advantages of the invention will become apparent from the following detailed description of preferred embodiments when read in conjunction with the accompanying drawings.

DESCRIPTION OF PREFERRED EMBODIMENTS

Figure 1:
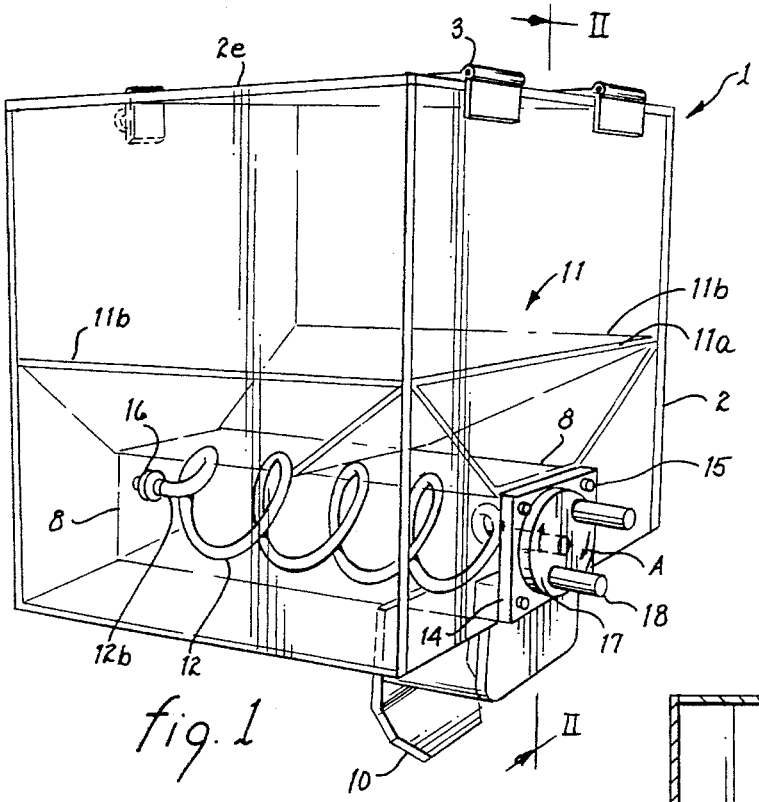
FIG. 1 is a perspective view of a dispenser in accordance with the invention.
Figure 3:
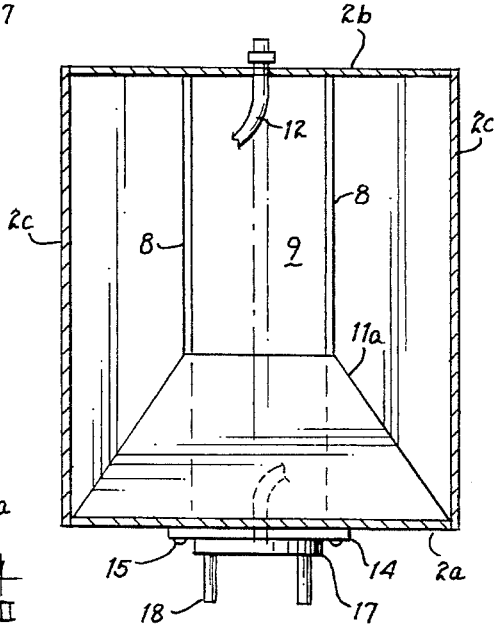
FIG. 3 is a sectional view in the direction of the arrows III—III of FIG. 2.
Figure 2:
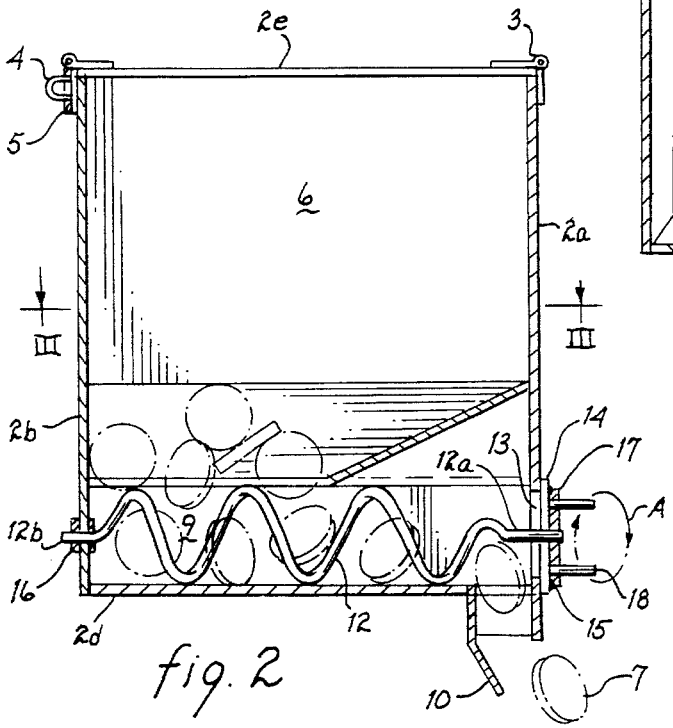
FIG. 2 is a sectional view in the direction of the arrows II—II of FIG. 1.

Referring to FIGS. 1–3, a dispenser is generally identified by the reference numeral 1. The dispenser 1 includes a container 2 having a front wall 2*a*, a rear wall 2*b*, side walls 2*c*, a bottom wall 2*d* and a lid 2*e*. The lid 2*e* is pivotally mounted on the front wall 2*a* by means of a pair of hinges 3. The rear wall 2*b* of the container 2 carries a tongue 4 which projects rearward from the rear wall 2*b* while the rear end of the lid 2*e* supports a latch 5 which is pivotable up-and-down about a horizontal axis. The latch 5 is provided with a slot and, when the lid 2*e* is closed and the latch 5 is pivoted downwards, the tongue 4 is received in the slot so as to arrest the lid 2*e* and prevent it from being opened.

The container 2 defines a storage chamber 6 for discrete commodities 7 to be dispensed by the dispenser 1. The commodities 7 are here individual unpackaged cookies. The chamber 6 can be stocked with cookies 7 by releasing the latch 5 and lifting the lid 2*e*.

Two partitions 8 are mounted on the bottom wall 2*d* of the container 2 and project upward into the chamber 6. The partitions 8, which are short in comparison to the container walls 2*a*,2*b*,2*c*, are spaced from one another laterally of the container 2 and extend from the container front wall 2*a* to the container rear wall 2*b*. The partitions 8 define a trough 9 which is centered between the container side walls 2*c*. A discharge chute or outlet 10 for the cookies 7 opens to the trough 9 near the container front wall 2*a*.

A funnel 11 is situated above the trough 9 and serves to direct the cookies 7 in the chamber 6 to a rear section of the trough 9, that is, a section of the trough 9 remote from the discharge chute 10. The funnel 11 includes a forward guide wall 11*a* and two lateral guide walls 11*b*. The forward guide wall 11*a* is inclined downward from the container front wall 2*a* to the partitions 8 while each of the lateral guide walls 11*b* is inclined downward from a respective container side wall 2*c* to the nearest partition 8.

A screw conveyor 12 is located in the trough 9 and extends from the container front wall 2*a* to the container rear wall 2*b*. The container front wall 2*a* has an opening 13 in line with the longitudinal axis of the screw conveyor 12, and the screw conveyor 12 can be withdrawn from and inserted in the trough 9 via the opening 13. A closure or cover 14 is provided for the opening 13 and is releasably connected to the container front wall 2*a* by screws or other suitable fasteners 15.

The screw conveyor 12 has a rear end portion 12*b* which is rotatably supported by a bearing 16 mounted on the container rear wall 2*b*. The screw conveyor 12 further has a front end portion 12*a* which passes through the opening 13 and an aligned passage in the cover 14. The front end portion 12*a* of the screw conveyor 12 is connected to a handwheel 17 disposed outward of and adjacent to the cover 14. The handwheel 17, which drives the screw conveyor 12 in rotation, is provided with a pair of handles 18 to facilitate manual operation of the handwheel 17.

The container 2 is preferably transparent. This not only allows a consumer to view the contents of the container 2 but provides an element of interest since the consumer can observe the dispensing process.

The dimensions of the dispenser 1 are advantageously such that the dispenser 1 can be set on a tabletop or counter top. Moreover, it is preferred for the dispenser 1 to be constructed of lightweight materials so that the dispenser 1 is portable, i.e., capable of being carried by an individual.

The placement of the arresting tongue 4 at the end of the dispenser 1 opposite the handwheel 17 and discharge chute 10 has at least two advantages. On the one hand, it makes it difficult for a consumer to lift the lid 2*e* and gain access to the storage chamber 6. On the other hand, such placement affords a clerk or other authorized person standing behind a tabletop or counter top easy access to the chamber 6 for the purpose of stocking or cleaning the chamber 6.

In operation, the container 2 is stocked with cookies 7 by lifting the lid 2*e* and placing the cookies 7 in the storage chamber 6. The cookies 7 descend under the action of gravity and are guided into the rear section of the trough 9 by the funnel 11.

The trough 9 defines a path of travel for the cookies 7 and such path extends from the container rear wall 2*b* to the container front wall 2*a*. The cookies 7 travel along the path in a direction from the container rear wall 2*b* towards the container front wall 2*a* so that the rear section of the trough 9 constitutes an upstream section of the path and the discharge chute 10 is located in a downstream section of the path.

When a consumer wishes to dispense cookies 7 from the container 2, the consumer rotates the handwheel 17 in the direction indicated by the arrows A. The screw conveyor 12 rotates in response to rotation of the handwheel 17 and urges cookies 7 which have descended into the trough 9 away from the container rear wall 2*b*, and towards the container front wall 2*a*, along the path defined by the trough 9. As the screw conveyor 12 rotates, each cookie 7 in the trough 9 is repeatedly impacted by forces having a first component in downstream longitudinal direction of the path defined by the trough 9 and a second component radially of the path. Upon reaching the discharge chute 10, the cookies 7 fall out of the container 2 by gravity into the hands of the consumer or into a box or bag held by the consumer.

Various modifications are possible within the meaning and range of equivalence of the appended claims.

I claim:

1. A dispenser for discrete commodities comprising in combination a container having an outlet and defining a storage chamber for the commodities; a screw conveyor in said chamber arranged to advance the commodities towards said outlet; means for driving said screw conveyor; and partitioning means in said chamber defining a trough which opens to said outlet, said screw conveyer being located in said trough, said trough having a section remote from said outlet, and said guide means being arranged to direct the commodities into said section.

2. The dispenser of claim 1, further comprising guide means in said chamber for directing the commodities into said trough.

3. The dispenser of claim 2, wherein said guide means comprises a funnel-like member which opens to said trough.

4. The dispenser of claim 1, wherein said trough is substantially centered transversely of said chamber.

5. The dispenser of claim 1, wherein said container is dimensioned for tabletop or counter top placement.

6. The dispenser of claim 1, wherein said container, said screw conveyor and said driving means constitute a portable unit.

7. The dispenser of claim 1, wherein said container is transparent.

8. The dispenser of claim 1, wherein said driving means comprises a handwheel.

9. The dispenser of claim 1, wherein said driving means is located in the region of said outlet.

10. The dispenser of claim 1, wherein said container has a wall, and a lid to stock said chamber with the commodities; and further comprising hinge means pivotally connecting said lid to said wall.

11. The dispenser of claim 10, wherein said container has a first end and a second end and said outlet and said hinge means are located at said first end, said lid being pivotable between an open position and a closed position; and further comprising means at said second end for arresting said lid in said closed position.

12. The dispenser of claim 1, further comprising bearing means for said screw conveyor, said bearing means being mounted on said container.

13. A dispenser for discrete commodities comprising in combination a container having an outlet and defining a storage chamber for the commodities; a screw conveyer in said chamber arranged to advance the commodities towards said outlet; and means for driving said screw conveyer;

said screw conveyer having a longitudinal axis and said container being provided with an opening in line with said axis, said screw conveyor and said opening being dimensioned to permit withdrawal of said screw conveyor from said chamber via said opening.

14. The dispenser of claim 13, further comprising a closure for said opening, and means for releasably mounting said closure on said container.

15. The dispenser of claim 14, wherein said driving means is located adjacent said closure and said closure is provided with a passage, said screw conveyor extending through said passage to said driving means.

* * * * *